US012291877B2

(12) United States Patent
Holland

(10) Patent No.: US 12,291,877 B2
(45) Date of Patent: May 6, 2025

(54) FASTENING ASSEMBLY FOR DECKING

(71) Applicant: Deck Claw Pty Ltd, New Farm (AU)

(72) Inventor: Allan Holland, Tweed Heads (AU)

(73) Assignee: DECK CLAW PTY LTD, Queensland (AU)

( * ) Notice: Subject to any disclaimer, the term of this patent is extended or adjusted under 35 U.S.C. 154(b) by 193 days.

(21) Appl. No.: 18/120,517

(22) Filed: Mar. 13, 2023

(65) Prior Publication Data

US 2023/0417065 A1 Dec. 28, 2023

(30) Foreign Application Priority Data

Jun. 28, 2022 (AU) ..... 2022901802

(51) Int. Cl.
*E04F 15/02* (2006.01)

(52) U.S. Cl.
CPC .. *E04F 15/02044* (2013.01); *E04F 15/02183* (2013.01); *E04F 2015/02111* (2013.01)

(58) Field of Classification Search
CPC ..... E04F 15/02044; E04F 15/02183; E04F 2015/02111; E04F 15/02194; E04F 21/0092; E01C 5/005; E01C 5/006; F16B 5/002; F16B 5/0685; F16B 5/0692
See application file for complete search history.

(56) References Cited

U.S. PATENT DOCUMENTS 3,073,421 A * 1/1963 Bock ..... E04F 13/0823 52/775
8,806,829 B2 * 8/2014 Pelc ..... E04F 15/02 411/902
10,113,306 B2 * 10/2018 Brigham ..... E04F 15/02044
10,590,978 B2 3/2020 Shadwell
11,193,284 B2 * 12/2021 Stuchell ..... E04F 21/0092
11,326,355 B2 * 5/2022 Bergelin ..... E04F 15/102
(Continued)

FOREIGN PATENT DOCUMENTS

AU 2009329819 B2 7/2016
CN 203097202 U 7/2013
(Continued)

OTHER PUBLICATIONS

ArmorGuard EDGE Hidden Deck Clip http://www.homedepot.com/p/Fiberon-ArmorGuard-EDGE-Hidden-Deck-Clip-09-Count-BKT-BRD-AG-CE-90CT/316484020; accessed Jan. 10, 2023.
(Continued)

*Primary Examiner* — Theodore V Adamos
(74) *Attorney, Agent, or Firm* — K&L Gates LLP

(57) ABSTRACT

A fastening assembly for decking having a plurality of joists with planks positioned on the joists includes a spacer for positioning on a joist between adjacent planks, the spacer having a predetermined overall thickness so that the spacer serves to maintain a desired spacing between the planks. The fastening assembly includes at least one gripping member, the gripping member including opposed arms and a web that interconnects the arms, with the spacer being receivable between the arms, the spacer and the arms being configured so that when the spacer is received between the arms, the arms are driven away from each other so that free ends of the arms bear against respective adjacent sides of said adjacent planks to secure the planks to the spacer.

16 Claims, 12 Drawing Sheets

(56) References Cited

U.S. PATENT DOCUMENTS

| | | | | |
|---|---|---|---|---|
| 2010/0257806 | A1* | 10/2010 | Snell | F16B 5/0072 52/705 |
| 2019/0055738 | A1* | 2/2019 | Vandenberg | F16B 5/0088 |
| 2021/0277668 | A1* | 9/2021 | Vandenberg | E04F 15/02044 |
| 2021/0301543 | A1 | 9/2021 | Carlson et al. | |
| 2021/0381257 | A1* | 12/2021 | Stuchell | F16B 5/0258 |
| 2021/0388622 | A1 | 12/2021 | Vernon et al. | |
| 2022/0010825 | A1 | 1/2022 | Voß | |
| 2022/0136547 | A1 | 5/2022 | Vandenberg et al. | |

FOREIGN PATENT DOCUMENTS

| | | | | |
|---|---|---|---|---|
| CN | 217299631 | U | 8/2022 | |
| DE | 202014106127 | U1 * | 4/2016 | E04F 13/0826 |
| DE | 202019106518 | U1 | 1/2020 | |
| EP | 2415946 | A3 | 8/2016 | |
| JP | 3605736 | B2 | 12/2004 | |
| KR | 100989996 | B1 | 10/2010 | |
| KR | 101053238 | B1 | 8/2011 | |
| KR | 102095981 | B1 * | 4/2020 | |

OTHER PUBLICATIONS

English Translation of Abstract German application No. DE202019106518U1.
English Translation of Abstract of Chinese No. 203097202U.
English Translation of Abstract of Chinese No. 2172996311(U).
English Translation of Abstract of Japanese Publication No. 3605736(B2).
English Translation of Abstract of Korean Publication No. 100989996(B1).
English Translation of Abstract of South Korean Publication No. 101053238(B1).
English Translation of European Publication No. 2415946 B1.
Trex 50 Sq. Ft. Universal Hidden Fasteners-Combo Pack; https://www.homedepot.com/p/Trex-50-sq-ft-Universal-Hidden-Fasteners-Combo-Pack-UNIVCOMBOCLIP01/203764337; accessed Jan. 10, 2023.

* cited by examiner

FASTENING ASSEMBLY FOR DECKING

CROSS-REFERENCE TO RELATED APPLICATIONS

This United States utility application claims benefit under 35 U.S.C. § 119(b) of Australian Application Serial No. 2022901802 filed on Jun. 28, 2022 entitled on "A Fastening Assembly for Decking" and whose entire disclosure is incorporated by reference herein.

FIELD OF THE INVENTION

This invention relates to a fastening assembly for decking. The invention also relates to a decking assembly, and to a method of assembling decking.

BACKGROUND OF THE INVENTION

The fastening of decking planks to joists is traditionally done by nailing or screwing the decking planks to the joist to form decking or a deck. This requires that each plank be evenly spaced from a preceding plank prior to fastening the plank to the joists. It is usual for spacers to be used to achieve such consistent spacing between the decking planks.

However, it remains a relatively difficult job for a layperson to secure decking planks to joists in an aesthetically and functionally acceptable manner. One of the issues is the fact that individual openings are often required to be drilled through the decking planks and partially into the joists prior to screwing in the screws, or otherwise driving fasteners, such as nails, through the openings and the joists. This drilling of openings is particularly necessary with hardwoods to avoid splitting or deformation of the screws or nails during the fastening process. Not only is the process time-consuming, but there is the added aesthetic requirement that the openings be evenly spaced so that heads of the fasteners are set out in an acceptable pattern.

An issue with the fastening of planks to joists by using fasteners that pass through the planks is that it can be difficult to dismantle the decking without damaging the planks. This is particularly undesirable when the planks have high value, such as hardwood planks, and are required to be re-used or recycled. Even if the planks can be removed without splintering or cracking, the fasteners need to be removed, leaving openings in the planks. This limits the ability to recycle the planks.

A variety of fastening arrangements have become available, which are directed to achieving a quicker and simpler deck assembly process.

However, such fastening arrangements often require that the decking planks be modified to suit the fastening arrangements. This can include a groove or shoulder extending along vertical sides of the decking planks. As a result, such fastening arrangements are not suitable for conventional planks, thus limiting the choice of decking. Furthermore, planks of high-value timber, such as various hardwoods, are generally not provided with such grooves or shoulders. Such planks are often recycled and refurbished from older sites, so are usually conventional, with flat sides. It follows that such fastening arrangements are not suitable for such planks.

SUMMARY OF THE INVENTION

According to a first aspect of the invention, there is provided a fastening assembly for decking having a plurality of joists with planks positioned on the joists, the fastening assembly comprising:

a spacer for positioning on a joist between adjacent planks, the spacer having a predetermined overall thickness so that the spacer serves to maintain a desired spacing between the planks; and at least one gripping member, the gripping member including opposed arms and a web that interconnects the arms, with the spacer being receivable between the arms, the spacer and the arms being configured so that when the spacer is received between the arms, the arms are driven away from each other so that free ends of the arms bear against respective adjacent sides of said adjacent planks to secure the planks to the spacer.

The spacer may define at least one passage that extends top to bottom, through the spacer, the web of the, or each, gripping member defining an opening, so that a shank of a fastener can be received through the web and the passage to engage the joist and drive the gripping member towards the joist so that the spacer is received between the arms, as the spacer is fastened to the joist.

The spacer may include end locating formations with a width corresponding to the predetermined thickness, and an intermediate portion interposed between the end locating formations, the intermediate portion being receivable between the arms of the, or each, gripping member, the intermediate portion and the arms being configured so that when the intermediate portion is received between the arms, the arms are driven away from each other so that the free ends of the arms bear against respective adjacent sides of said adjacent planks.

The intermediate portion may define at least one spreader formation that is receivable between the arms of the gripping member to spread the arms as the gripping member is driven downwardly.

The, or each, spreader formation may have opposed sloped surfaces that extend downwardly and outwardly from the upper face of the spacer to facilitate spreading of the arms as the gripping member is driven downwardly.

Each arm of the gripping member may have a gripping portion that terminates the arm, the gripping portions extending outwardly to complement the sloped surfaces of the spreader formation.

Each gripping portion may define a sharpened point that can be driven into the planks, as the gripping member is driven towards the joist.

The intermediate portion may define guide slots on respective sides of the, or each, spreader formation, the gripping member having opposed walls that depend from respective sides of the web, each wall having two slots to define the arm and two legs, with the arm interposed between the legs, the legs and the guide slots being configured so that the legs can slide into the guide slots to bring the opening in the web into register with the passage through the spacer.

The fastening assembly may include two spreader formations, the intermediate portion defining a central portion interposed between end portions, each end portion being interposed between the central portion and one of the end locating formations, each end portion defining one of the spreader formations.

The central portion may define opposed faces, and each spreader formation may define opposed faces that terminate the sloped surfaces, the faces of the central portion and spreader formations being aligned with each other and inwardly offset with respect to the width of the end locating formations to provide a gap between the faces of the central portion and spreader formations and the respective adjacent sides of the adjacent planks.

Opposed spacing formations may extend from respective faces of the central portion, outer edges of the spacing formations defining a width that corresponds with the width of the end locating formations to maintain the gap between the faces of the central portion and spreader formations and the respective adjacent sides of the adjacent planks.

The fastening assembly may include one gripping member and one corresponding spreader formation, the spreader formation being interposed between the end locating formations.

The fastening assembly may include a cover mechanism that is operatively engageable with the spacer to cover the, or each, gripping member to protect the gripping member.

The cover mechanism may include at least one cover that is engageable with the spacer, the, or each, cover being hinged to the spacer and pivotal between an operative position in which the cover is located over the gripping member, and an inoperative position in which the cover is positioned away from the gripping member to facilitate access to the gripping member.

The, or each, cover and the spacer may include complementary, releasable securing formations so that the cover can be secured to the spacer in the operative position, and released from the carrier to be pivoted into the inoperative position.

The spacer may be shaped to accommodate an upper side of the joist, to facilitate positioning of the spacer on the joist.

The spacer may define at least one recess on each of the sides of the spacer, and accessible from the upper face of the spacer, each arm of the gripping member being slidably receivable, from the upper face towards a lower face of the spacer, in a respective one of the recesses, the recesses being shaped so that the arms are driven away from each other as the arms slide downwardly in the respective recesses.

At least a portion of a floor of each recess may be ramped outwardly and downwardly to cause the arms to be driven away from each other as the gripping member is driven downwardly.

The free end of each arm may define an outwardly extending ridge for embedding in the planks when the arms are driven away from each other.

According to a second aspect of the invention, there is provided a decking assembly that comprises:

a series of spaced joists;

a series of decking planks positioned, side-by-side on the joists, transversely with respect to the joists; and a plurality of fastening assemblies interposed between the decking planks, each fastening assembly comprising:

a spacer for positioning on one of the joists between adjacent planks, the spacer having a predetermined overall thickness so that the opposed sides serve to maintain a spacing between the planks; and at least one gripping member, the gripping member including opposed arms and a web that interconnects the arms, with the spacer being receivable between the arms, the spacer and the arms being configured so that when the spacer is received between the arms, the arms are driven away from each other so that free ends of the arms bear against respective adjacent sides of said adjacent planks to secure the planks to the spacer.

According to a third aspect of the invention, there is provided a method of assembling a deck with the fastening assembly of claim 1, the method comprising the steps of:

positioning at least two decking planks on a set of joists;

positioning the spacer of the fastening assembly between the planks to set a spacing between the decking planks; and driving the gripping member towards the joist so that the spacer is received between the arms and the arms are driven away from each other to bear against respective adjacent sides of said adjacent planks.

According to a fourth aspect of the invention, there is provided a method of assembling decking having a plurality of joists with planks positioned on the joists, with a fastening assembly that comprises a spacer for positioning on a joist between adjacent planks, the spacer having a predetermined overall thickness so that the spacer serves to maintain a desired spacing between the planks, and at least one gripping member including opposed arms and a web that interconnects the arms, with the spacer being receivable between the arms, the spacer and the arms being configured so that when the spacer is received between the arms, the arms are driven away from each other so that free ends of the arms bear against respective adjacent sides of said adjacent planks to secure the planks to the spacer, the method comprising the steps of:

positioning at least two decking planks on a set of joists;

positioning the spacer between the planks to set a spacing between the decking planks; and driving the gripping member towards the joist so that the spacer is received between the arms and the arms are driven away from each other to bear against respective adjacent sides of said adjacent planks.

According to a fifth aspect of the invention, there is provided decking assembled according to the above method.

DETAILED DESCRIPTION

Figure 1:
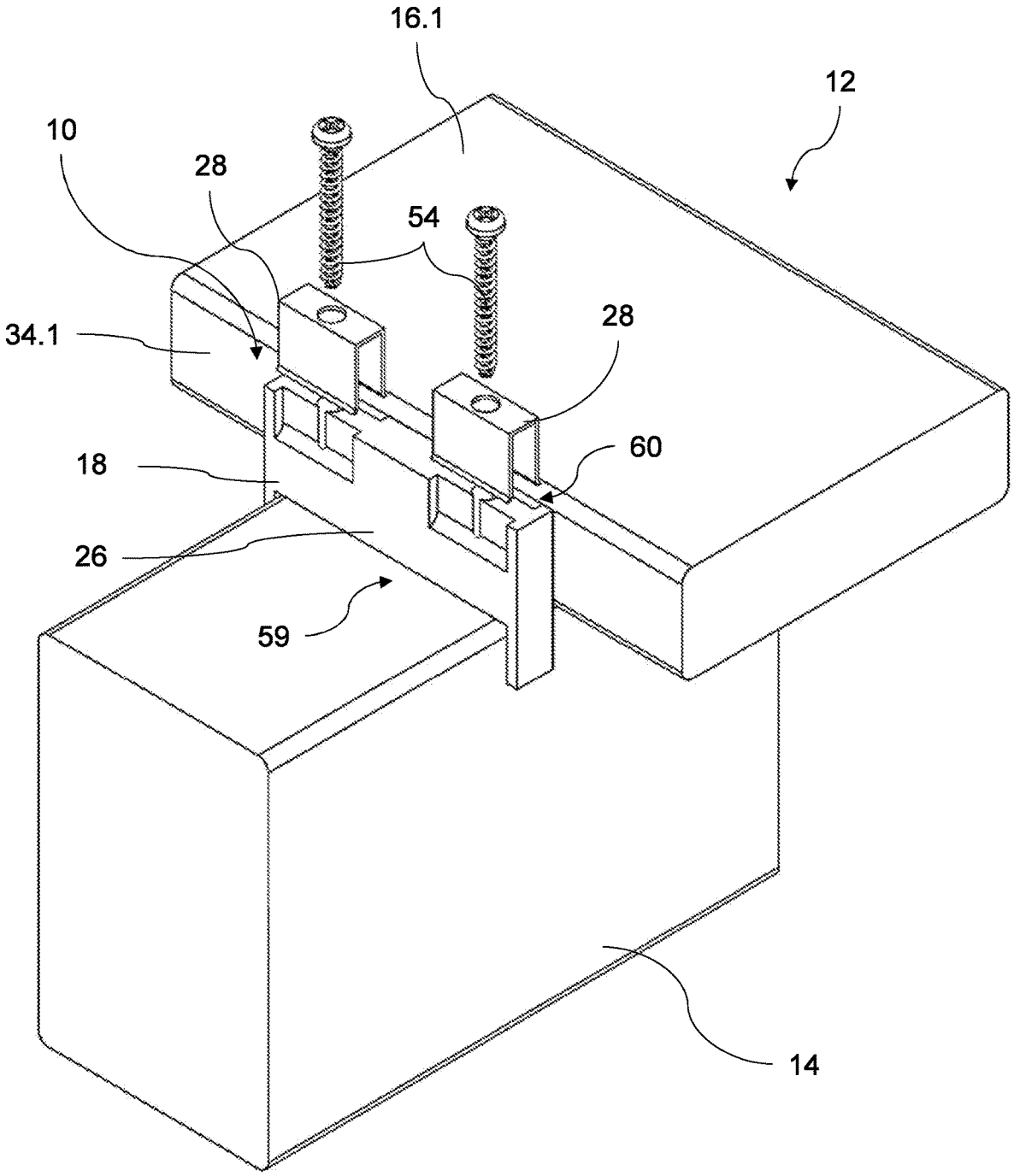
FIG. 1 shows a three dimensional, exploded view of one embodiment of a fastening assembly, in accordance with the invention, for decking, in use.

In the drawings, reference numeral 10 generally indicates an embodiment of a fastening assembly, in accordance with the invention, for decking 12, also in accordance with the invention.

Figure 16:
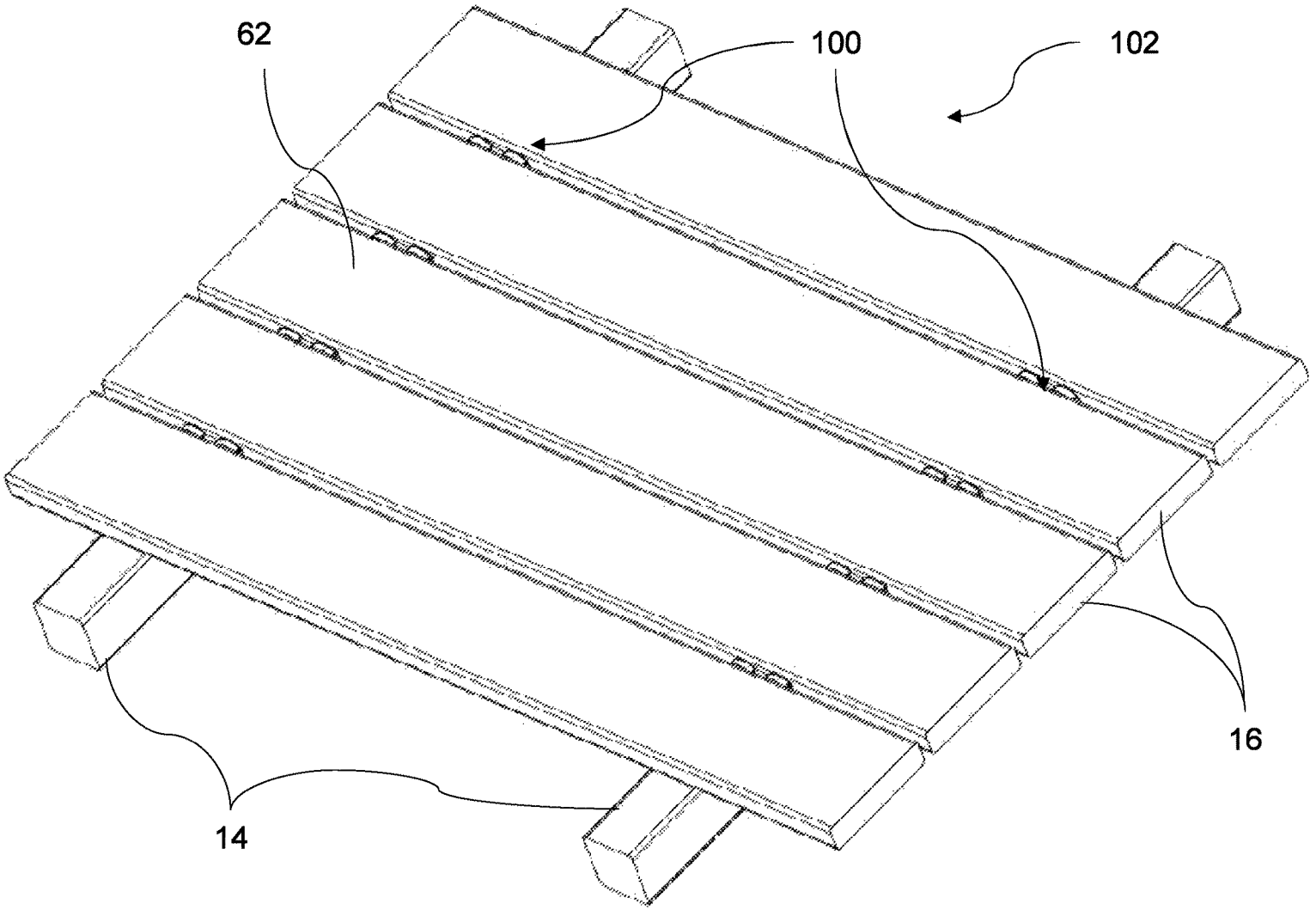
FIG. 16 shows a deck that has been assembled using fastening assemblies of FIG. 6.

The decking 12 includes a plurality of joists, one of which is shown at 14 and decking planks 16 positioned on the joists 14 (FIG. 16).

Figure 2:
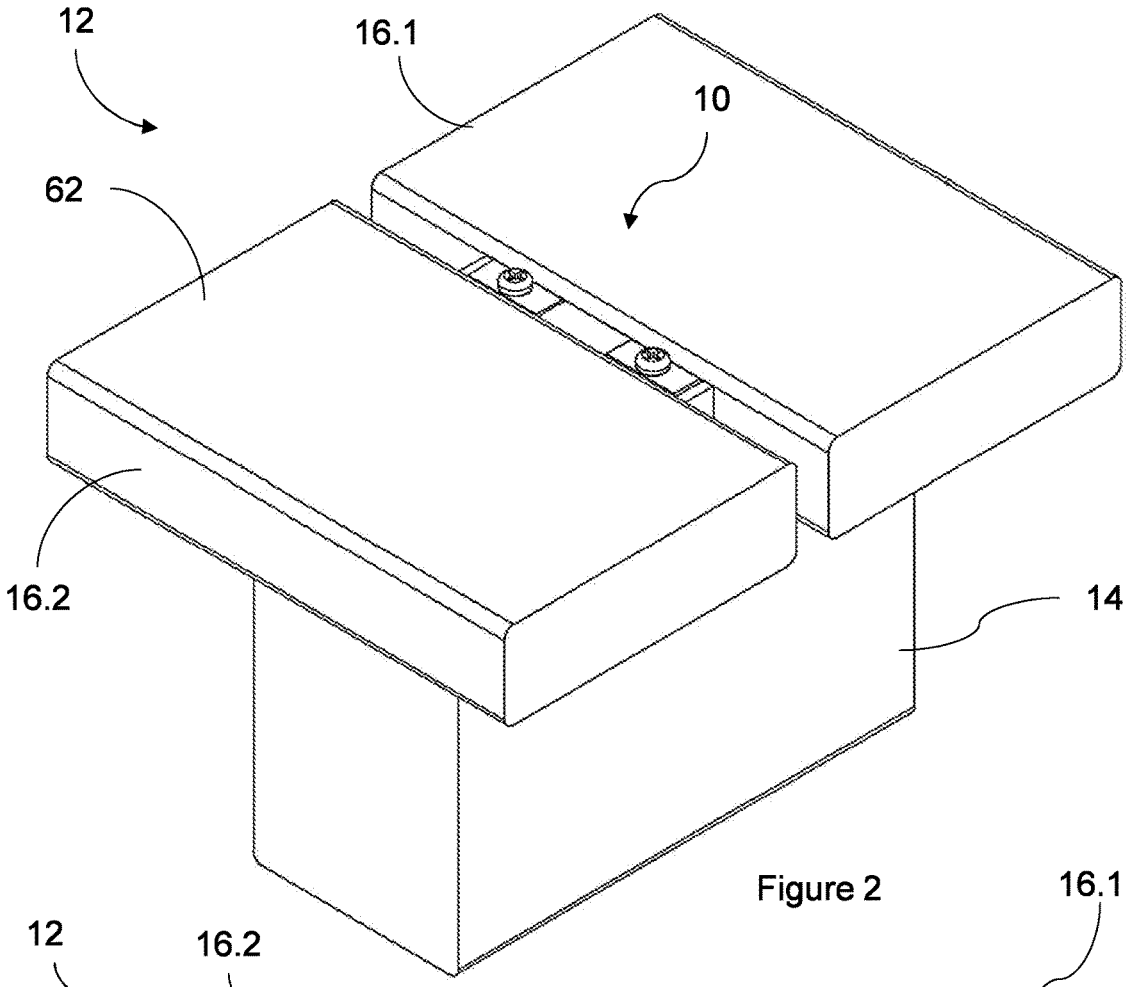
FIG. 2 shows the fastening assembly of FIG. 1, in use.

The fastening assembly 10 includes a spacer 18 for positioning on a joist 14 between adjacent planks 16.1, 16.2 (FIG. 2, 3). The spacer 18 is fastenable to the joists 14. For convenience and ease of description, one joist 14 and two planks 16.1, 16.2 are shown. It will readily be appreciated that the decking 12 includes a plurality of the joists 14 and planks 16 (see FIGS. 15, 16).

Figure 4A:
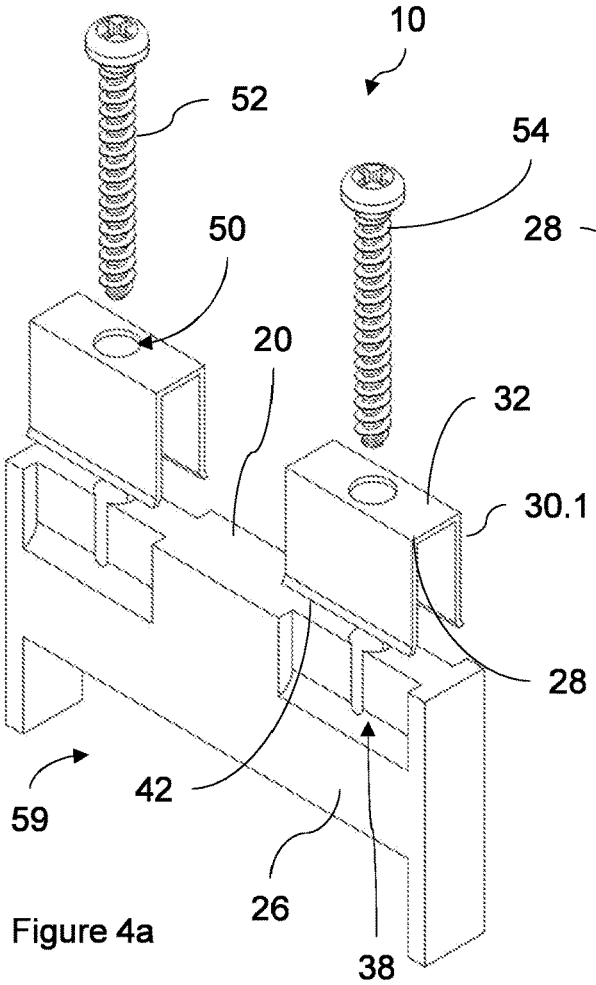
FIGS. 4*a*-4*c* show three consecutive stages in the use of the fastening assembly of FIG. 1.
Figure 4B:
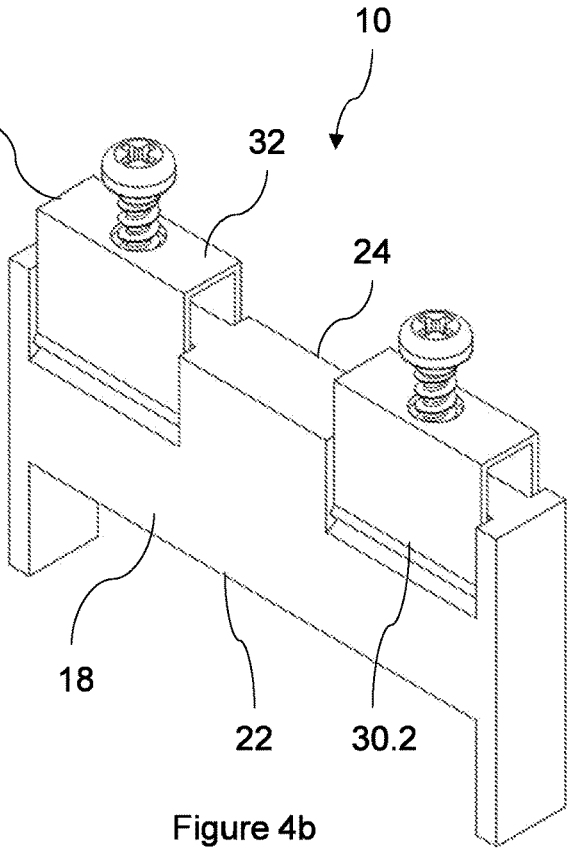
Figure 5:
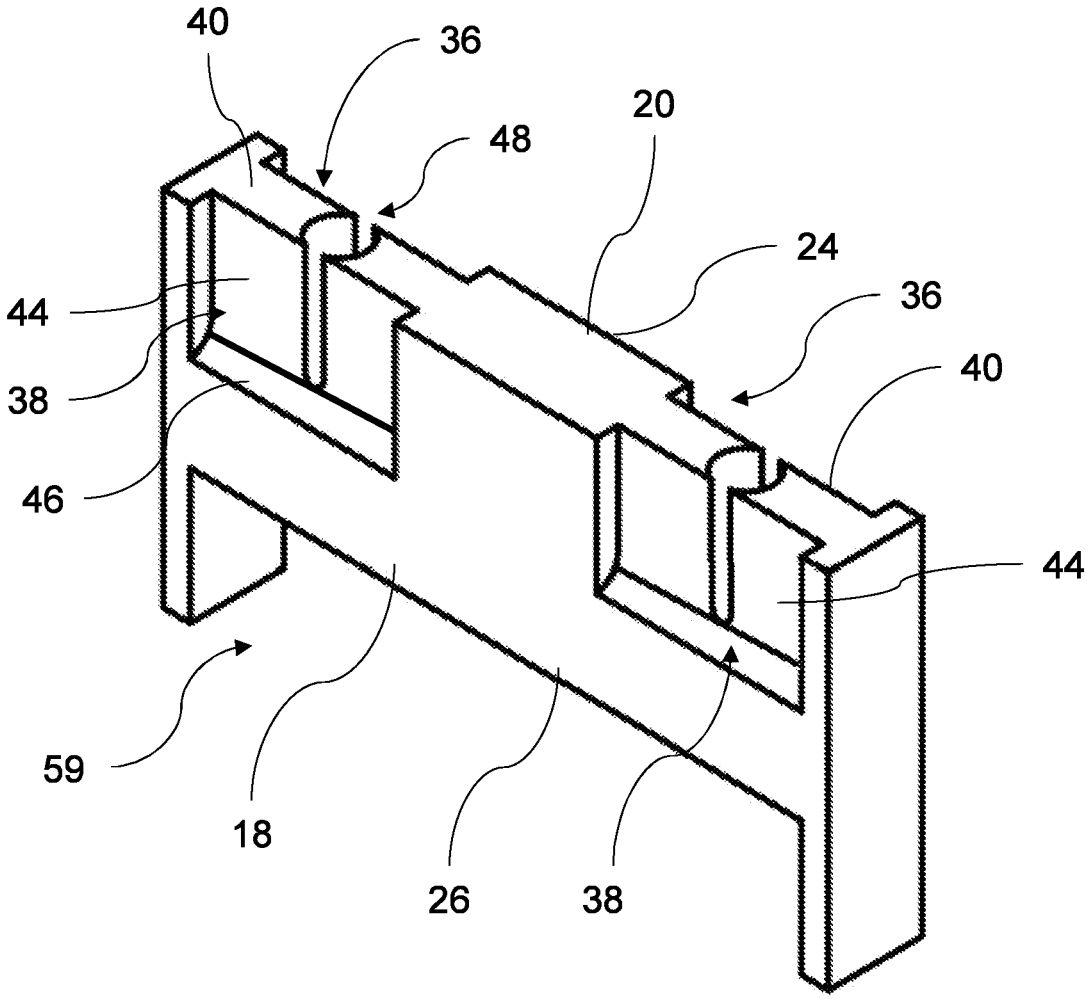
FIG. 5 shows a three-dimensional view of a spacer of the fastening assembly of FIG. 1.

The spacer 18 has opposed upper and lower faces 20, 22, and opposed sides 24, 26 (FIG. 4*a*, 4*b*, 5). The spacer 18 has a predetermined overall thickness so that the spacer 18 can serve to maintain a desired spacing between the planks 16. It will be appreciated that the spacer 18 can have a wide range of dimensions, whether it be height, width, or overall thickness, to suit various dimensions of joists and planks.

Figure 3:
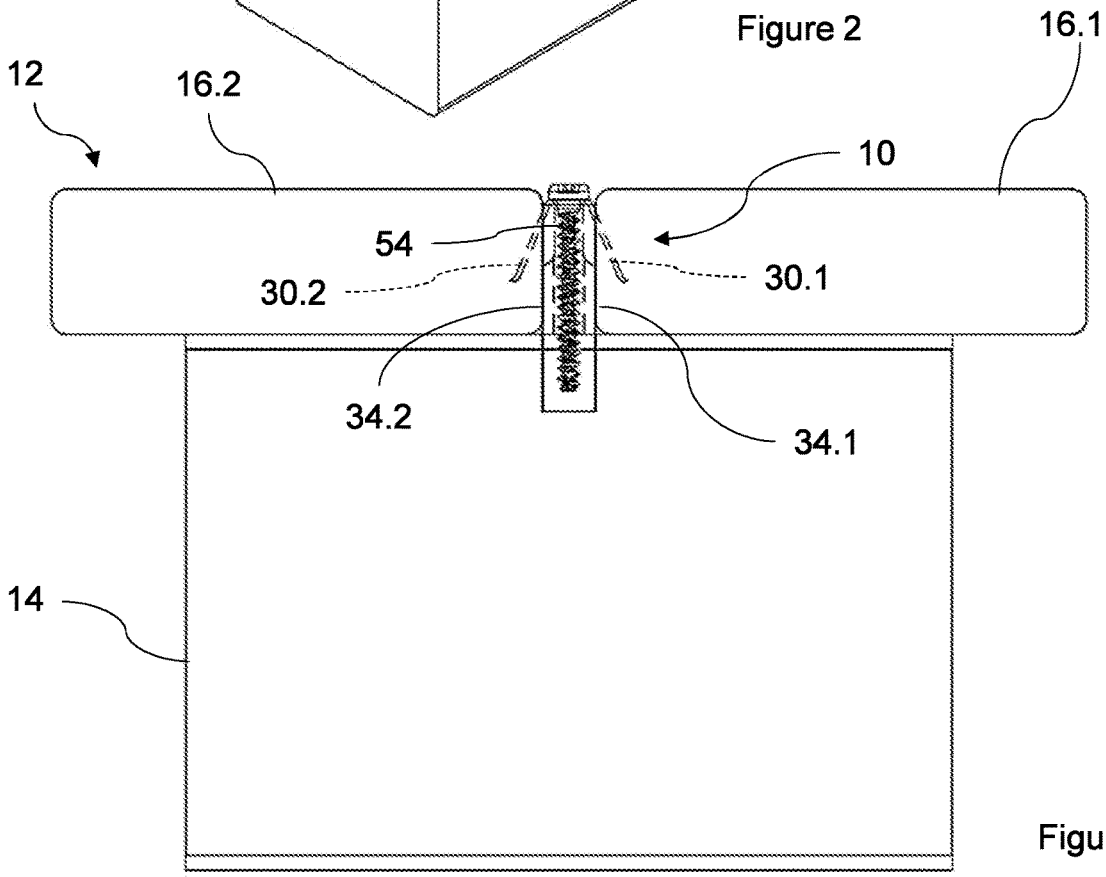
FIG. 3 shows a schematic, sectioned side view of the fastening assembly of FIG. 1, in use.

The fastening assembly 10 includes two gripping members 28. Each gripping member 28 includes opposed arms 30.1, 30.2 and a web 32 that interconnects the arms 30. The spacer 18 is receivable between the arms 30.1, 30.2. The spacer 18 and the arms 30.1, 30.2 are configured so that when the spacer 18 is received between the arms 30.1, 30.2, the arms 30.1, 30.2 are driven away from each other, or spread, as the web 32 is displaced or driven towards the upper face 20, so that free ends 42 of the arms 30 bear against respective adjacent vertical sides 34.1, 34.2 of said adjacent planks 16. This is shown in FIG. 3, where the displacement of the arms 30.1, 30.2 is exaggerated for illustrative purposes.

The spacer 18 defines two recesses 36 in the side 24, and two recesses 38 in the side 26, the recesses 36 are aligned with respective recesses 38 (FIG. 5). The recesses 36, 38 are accessible from the upper face 20. Thus, when viewed from above, a profile of the spacer 18 defines two, spaced narrowed portions 40. Each recess 36, 38 includes an operatively vertical floor 44 having a lower sloped or ramped portion 46 that is sloped or ramped outwardly and downwardly.

The arms 30.1, 30.2 have a width that corresponds generally with a width of the recesses 36, 38. The arms 30.1, 30.2 of each gripping member 28 are spaced to correspond generally with a thickness of each narrowed portion 40. Thus, each gripping member 28 can be slid into engagement with the spacer 18 such that the narrowed portions 40 are interposed between the arms 30.1, 30.2 of respective gripping members 28. Furthermore, when the ramped portions 46 of each floor 44 engage respective arms 30.1, 30.2, the arms 30.1, 30.2 are driven apart.

Thus, in use, when the spacer 18 is interposed between vertical sides 34.1, 34.2 of the decking planks 16.1, 16.2, respectively, the gripping members 28 can be slid into engagement with the spacer 18 until the arms 30.1, 30.2 are driven apart and bear against the vertical sides 34.1, 34.2 to grip the planks 16.1, 16.2, as described above.

The spacer 18 defines two passages 48 that extend, top to bottom, through the spacer 18, from the upper face 20, at the narrowed portion 40, to the lower face 22. The web 32 of each gripping member 28 defines an opening 50 (FIG. 4*a*). The openings 50 and the passages 48 are positioned so that, when each narrowed portion 40 is received between the respective two arms 30.1, 30.2, the openings 50 are brought into alignment with the respective passages 48. A threaded shank 52 of a fastener in the form of a screw 54 is received through corresponding respective openings 50 and passages 48 and driven into the joist 14. During that operation, a head 56 of each screw 54 bears against the web 32, to drive the arms 30.1, 30.2 over the associated ramped portions 46. This causes the arms 30.1, 30.2 to be displaced outwardly, to bear against the sides 34.1, 34.2 (FIG. 3). The screws 54 can be self-tapping screws suitable for screwing into wooden joists without the need for drilling.

Figure 4C:
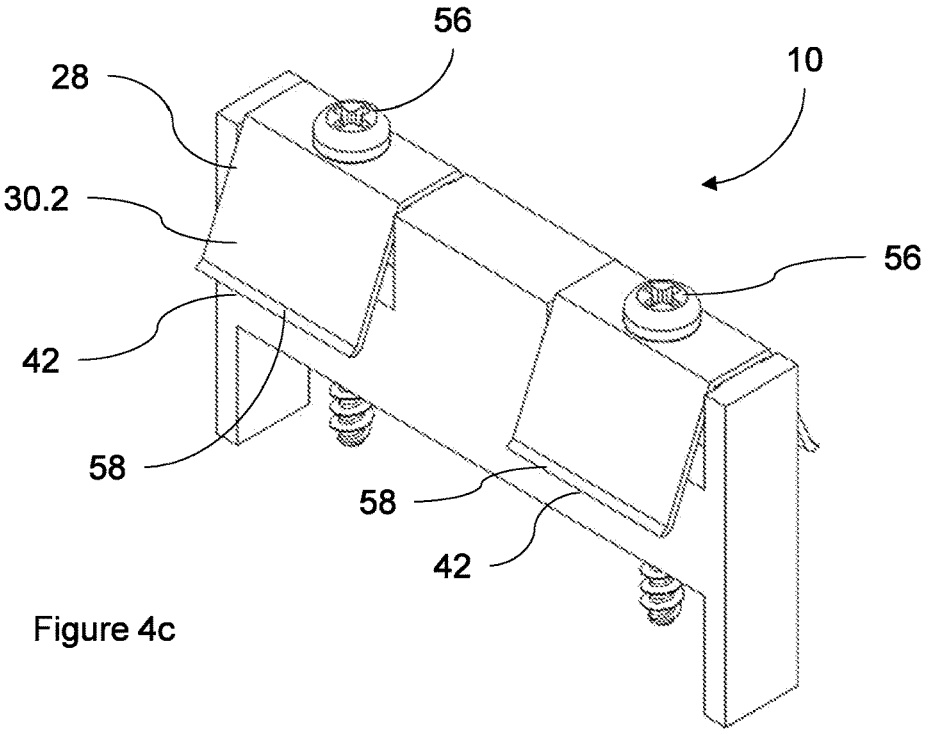

The free ends 42 of the arms 30.1, 30.2 are defined by an outwardly extending rib or ridge 58 (FIG. 4*c*). Thus, when the arms 30 are driven outwardly, the ridges 58 dig into the sides 34.1, 34.2, to lock the planks 16 relative to the gripping members 28. At the same time, the fasteners 54 serve to fasten the gripping members 28 and the spacer 18 to the joist 14. Thus, the planks 16 are secured to the joist 14 when the screws 54 are driven into the joist 14.

The lower face 22 of the spacer 18 is shaped to accommodate the joists 14 to facilitate positioning of the spacers 18 on the joist 14. To that end, the lower face 22 defines a recess 59 (FIGS. 1, 4*a*) that is dimensioned so that the joist 14 can nest in the recess 59. It will be appreciated that the recess 59 can have a range of dimensions suited to various joists. In one example, the recess 59 can have a width that complements a standard joint width.

The spacer 18 is dimensioned so that the heads 56 of the screws 54 are positioned below or flush with a decking surface 62 (see also FIG. 16) once the planks 16 are fastened to the joist 14. This facilitates sanding, oiling, or other operations or activities on the decking surface 62 without interference by the screws 54.

Figure 15:
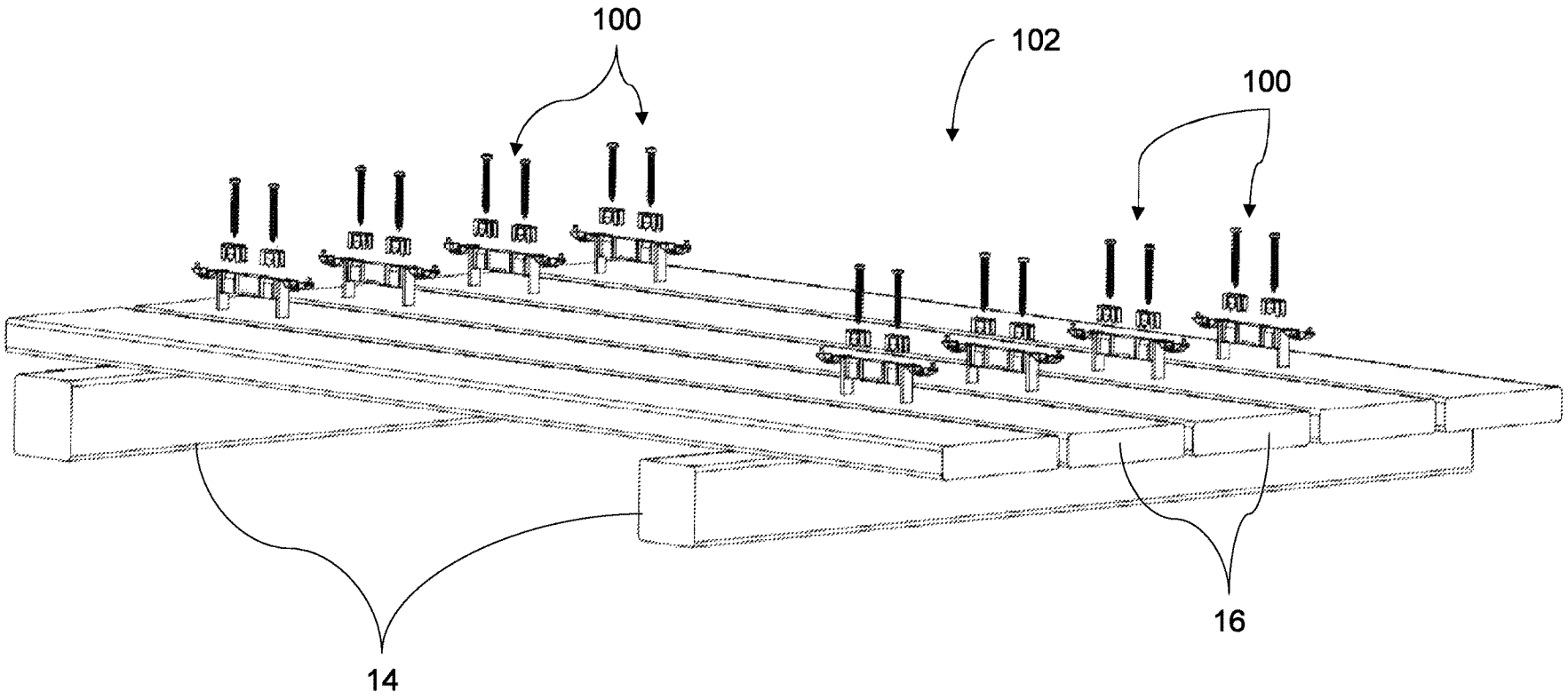
FIG. 15 shows use of the fastening assembly of FIG. 6, fastening decking planks to form a deck.

In use, the planks 16.1, 16.2 are laid side-by-side with the spacer 18 interposed between the adjacent vertical sides 34.1, 34.2 of the planks 16.1, 16.2 (see for example, FIG. 15). The spacer 18, together with the planks 16.1, 16.2, can be slidably adjusted relative to the joist 14. This is facilitated by the nesting of the joist 14 in the recess 59. As can be seen in FIG. 1, the recesses 36, 38 and the associated vertical sides 34.1, 34.2 of the planks 16.1, 16.2 define openings 60 when the planks 16.1, 16.2 are in position (FIG. 1). The arms 30.1, 30.2 of each gripping member 28 are received in respective openings 60. The shanks 52 of the screws 54 are then received through the openings 50 and passages 48 and driven into the joist 14. This results in the gripping members 28 being driven towards the joist 14, causing the ridges 58 to dig into the vertical sides 34.1, 34.2 to fasten the planks 16 to the joist 14.

The gripping members 28 are of a resiliently flexible material with sufficient structural integrity to facilitate the necessary gripping action when they are driven towards the joist 14. Thus, the gripping members 28 can be of steel, such as spring steel.

It will be appreciated that it is not necessary to drive any fasteners through the planks 16, or to drill holes in the planks 16, in order to fasten the planks 16 to the joist 14. Furthermore, the planks 16 can be conventional planks of any material, such as hardwood, because the arms 30 grip the planks 16 without the need for grooves or any other formations on the vertical sides 34 of the planks 16. The fact that the planks 16 do not have fasteners driven though them or holes drilled through them significantly reduces the risk of damage to the planks 16.

Figure 6:
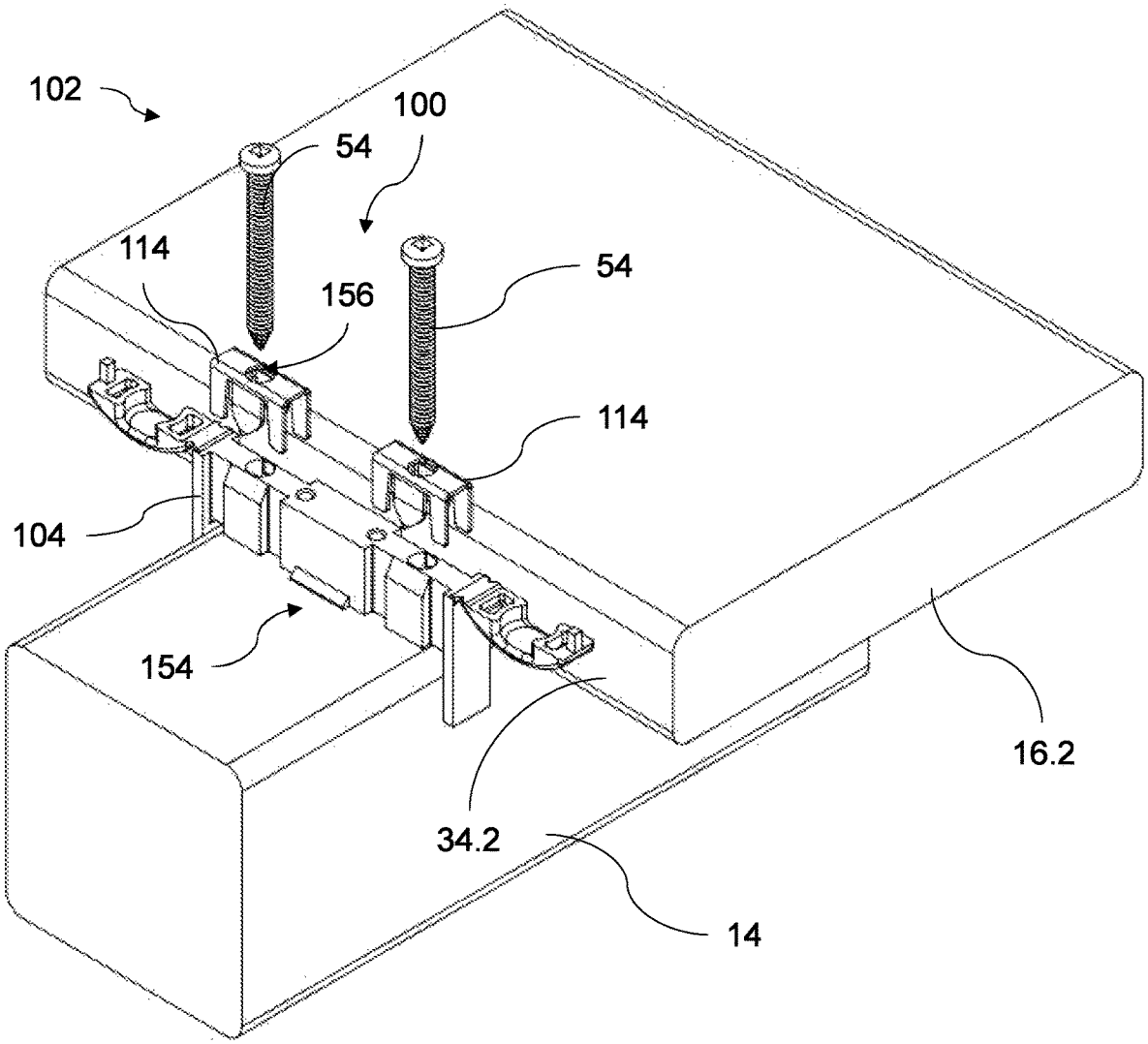
FIG. 6 shows a three dimensional, exploded view of one embodiment of a fastening assembly, in accordance with the invention, for decking, in use.

In FIG. 6, reference numeral 100 generally indicates an embodiment of a fastening assembly, in accordance with the invention, for decking 102, also in accordance with the invention (FIGS. 15, 16). With reference to the preceding drawings, like reference numerals refer to like parts, unless otherwise specified. The use of common reference numerals is for convenience only and is not intended to narrow the scope of the appended claims, or the above summary. Furthermore, the parts shown with reference to the fastening assembly 10 can be interchanged, where feasible, with parts shown with reference to the fastening assembly 100.

Figure 7:
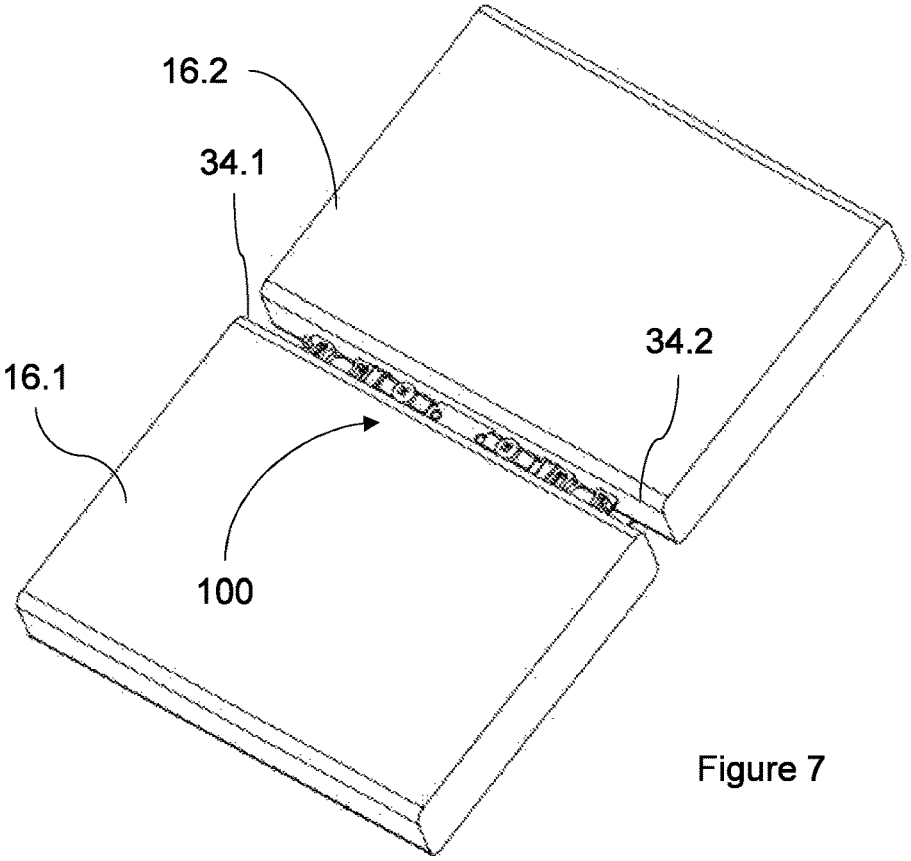
FIG. 7 shows the fastening assembly of FIG. 6, in use, with fastener covers in an open condition.
Figure 12:
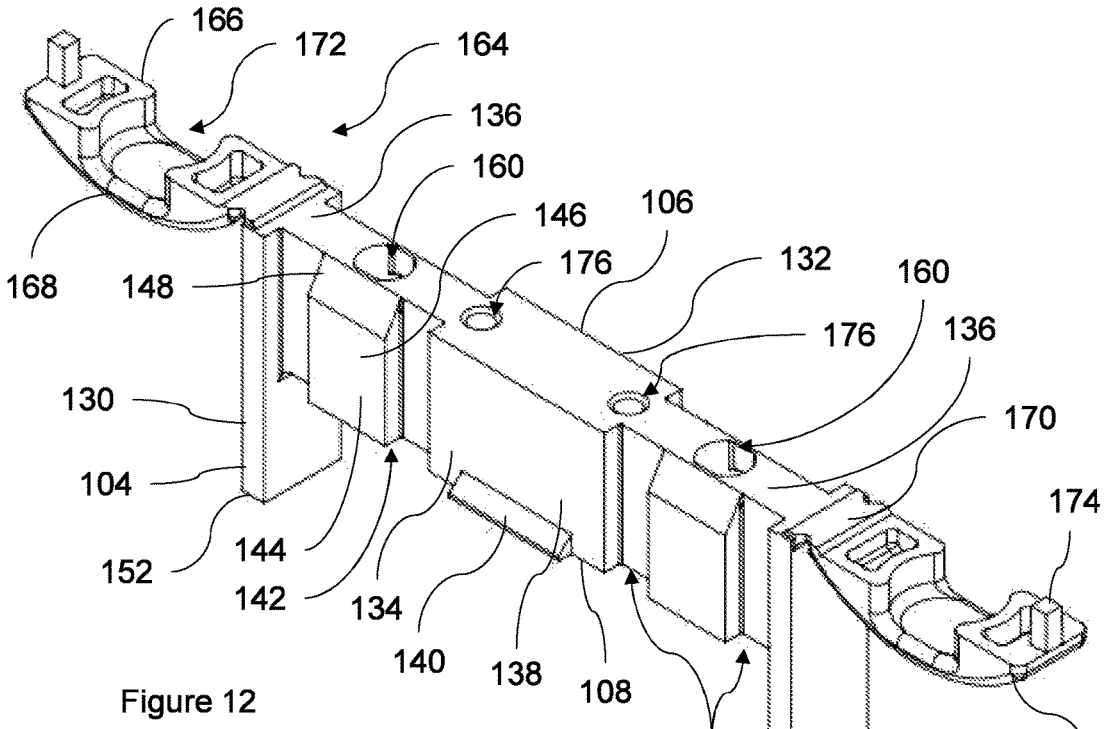
FIG. 12 shows a three-dimensional view of a spacer of the fastening assembly of FIG. 6.

The fastening assembly 100 includes a spacer 104 (see FIG. 12 for detail of the spacer 104) for positioning on the joist 12 between the adjacent planks 16.1, 16.2 (FIG. 7, 8). As before, for convenience and ease of description, one joist 14 and two planks 16.1, 16.2 are shown here. In FIGS. 15, 16, a plurality of planks 16 can be seen on two of the joists 14.

The spacer 104 has a predetermined overall thickness so that the spacer 104 can maintain a desired spacing between the planks 16.1, 16.2. during assembly of the decking 102.

The fastening assembly 100 includes two gripping members 114. Each gripping member 114 includes opposed arms 116.1, 116.2 and a web 118 that interconnects the arms 116.1, 116.2 The spacer 104 is receivable between the arms 116.1, 116.2. The spacer 104 and the arms 116.1, 116.2 are configured so that when the spacer 104 is received between the arms 116.1, 116.2, and driven towards the joist 14, the arms 116.1, 116.2 are driven away from each other so that free ends 120 of the arms 116.1, 116.2 bear against the respective adjacent vertical sides 34.1, 34.2 of the adjacent planks 16 (FIG. 10) to grip the planks 16.1, 16.2.

Figure 11A:
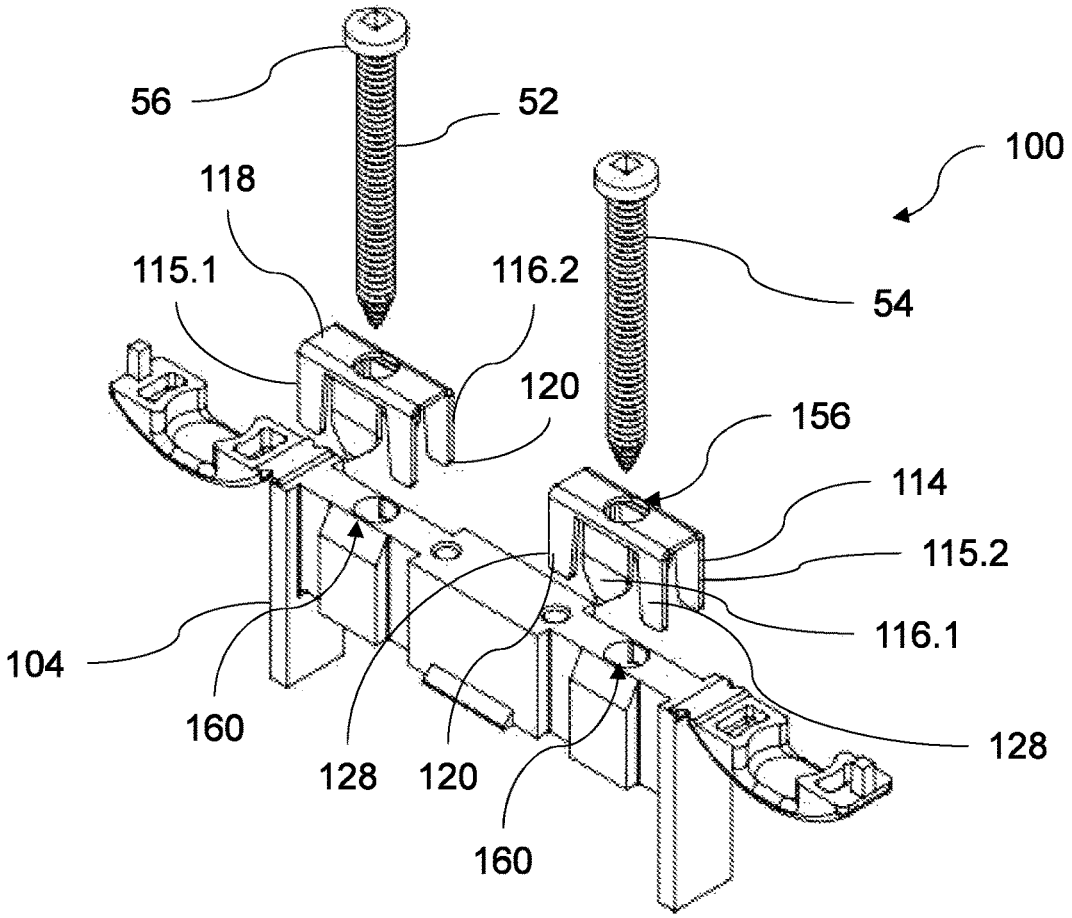
FIGS. 11*a*-11*d* shows four consecutive stages in the use of the fastening assembly of FIG. 6.
Figure 11B:
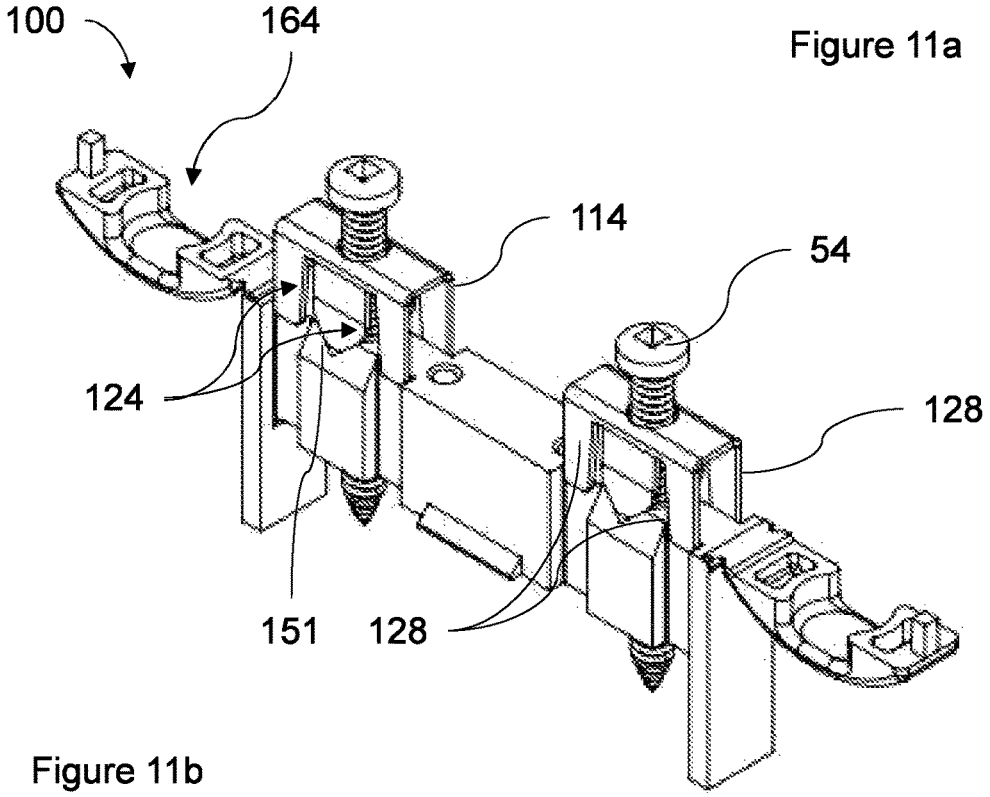

Each gripping member 114 includes opposed walls 115.1, 115.2. Each wall 115.1, 115.2 defines two slots 124 extending from the web 118 (FIG. 11*b*). The slots 124 provide each arm 116.1, 116.2, and two legs 128, each arm 116.1, 116.2 being interposed between the legs 128. The gripping member 114 is of a resiliently flexible material, such as steel, so that the arms 116.1, 116.2 can flex independently of the legs 128. Each gripping members 114 is of a resiliently flexible material with sufficient structural integrity to facilitate the necessary gripping action when they are driven towards the joist 14. Thus, the gripping members 114 can be of steel, such as spring steel.

The spacer 104 includes end locating formations, or locators 130, with a width that is the predetermined thickness referenced above. An intermediate portion 132 is interposed between the locators 130. The intermediate portion 132 and upper ends of the locators 130 are flush to define an upper face 106 of the spacer 104. The intermediate portion 132 includes a central portion 134 interposed between two end portions 136. The central portion 134 has opposed, generally flat faces 138 that are inwardly offset with respect to a width of the locators 130. A spacing portion 140 extends from each face 138 to terminate in alignment with sides of the locators 130. Thus, when the spacer 104 is seated or positioned between the consecutive planks 16.1, 16.2, the sides 34.1, 34.2 are retained in a spaced manner with respect to each other by the locators 130 and the spacing portions 140 during assembly of the decking 12.

Each end portion 136 defines a spreader formation 144. Each spreader formation 144 includes opposed, raised faces 146 that are in alignment with adjacent faces 138 of the central portion 134. Each end portion 136 defines two spaced guide slots 142 so that each spreader formation 144 is interposed between two sets of two opposed guide slots 142. Each slot 142 is dimensioned to accommodate one of the legs 128, in a sliding fit, to guide movement of the gripping member 114. The legs 128 and the slots 142 also facilitate correct positioning of the gripping member 114 with respect to the spacer 104 prior to driving the gripping member 114 towards the joist 14.

The spreader formation 144 has sloped faces 148 that extend outwardly and downwardly from the upper face 106 to terminate at respective raised faces 146 to facilitate spreading of the arms 116.1,116.2 as the gripping member 114 is driven downwardly towards the joist 14.

Figure 10:
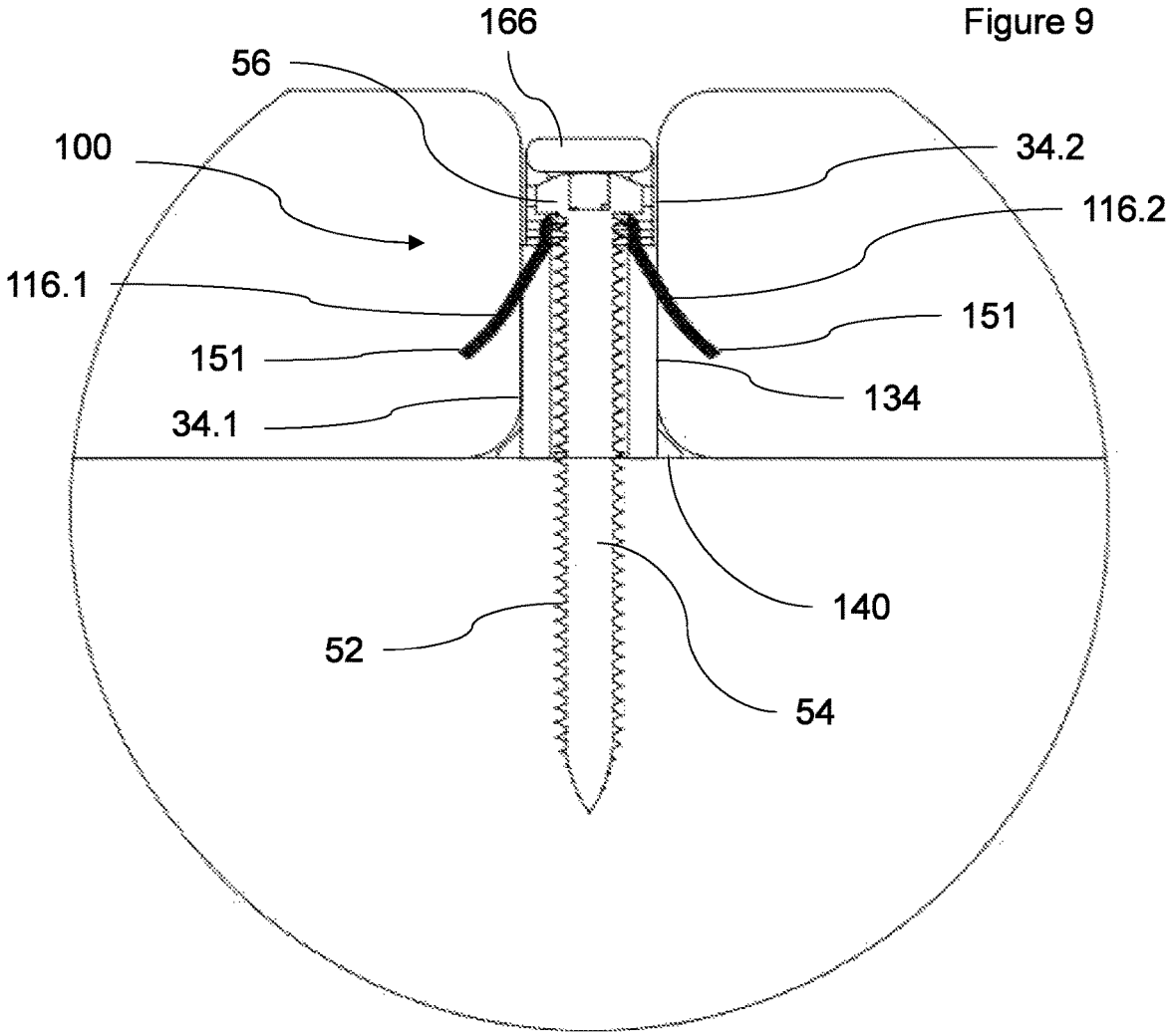
FIG. 10 shows a detailed view of the part "A" in FIG. 9.

Each arm 116.1, 116.2 includes an outwardly and downwardly extending end or gripping portion 150 that corresponds with the sloped face 148 of the spreader formation 144. The sloped faces 148 and the gripping portions 150 are configured so that the legs 128 can be received in respective slots 124 and the gripping member 114 can be driven downwardly so that the sloped faces 148 interact with the gripping portions 150 to spread the arms 116.1, 116.2. The gripping portions 150 are dimensioned and shaped to define pointed ends 151 (FIG. 10, 11*c*) that can be driven into the associated sides 34 when the web 118 is driven towards the intermediate portion 132. This is illustrated in FIG. 10.

The intermediate portion 132 and the locators 130 are shaped to accommodate an upper side of each joist 14. Thus, a generally rectangular recess 154 (FIG. 6) is defined by the locators 130 and the intermediate portion 132. The locators 130 and intermediate portion 132 are configured so that the joist 14 can be received in the recess 154 in a manner in which the spacer 104 is located on the joist 14 to facilitate sliding of the spacer 104 to-and-fro on the joist 14 for positional adjustment.

The web 118 of each gripping member 114 defines an opening 156 (FIG. 11*a*) through which the threaded shank 52 of the screw 54 can be received. The intermediate portion 132 defines two passages 160, each between the two raised faces 146 of respective spreader formations 144 and extending, top to bottom, from the upper face 106 through the intermediate portion 132. Thus, each threaded shank 52 can be received through respective aligned openings 156 and passages 160 to be screwed into the joists 14 while the web 118 is driven towards the intermediate portion 132 and the joist 14 by the fastening action of the screw 54, and the spreader formations 144 are received between the arms 116.1, 116.2 of respective gripping members 114.

In use, two or more of the gripping members 114 are positioned or located on the joists 14 to space the planks 16, as shown in FIGS. 6 and 15. In that position, the locators 130 and the spacing portions 140 bear against the adjacent sides 34.1, 34.2 to maintain spacing between the decking planks 16 that is equivalent to the predetermined overall width. This creates a space 160 between the faces 138, 146 and the sides 34.1, 34.2 to facilitate pushing or positioning of the legs 128 partially in the slots 142 with the gripping portions 150 of the gripping members 114 in sliding engagement with the sloped faces 148. The threaded shanks 52 are inserted through the openings 156 and the passages 160 and screwed into the joists 14. During that operation, the head 56 bears against the web 118 and drives it towards the intermediate portion 132, causing the arms 116.1, 116.2 to be driven away from each other or spread so that the pointed ends 151 are driven into the sides 34.1, 34.2 to secure the fastening assembly 100 to the planks 16.1, 16.2, and to the joists 14. FIG. 10 shows the orientation of the walls 116.1, 116.2 in their operative condition.

The fastening assembly 100 includes a cover mechanism 164 that is operatively engaged with the spacer 104 to cover the gripping members 114 and screws 54 to protect those components. The cover mechanism 164 is configured to be detachably arranged on the body 126 to cover the gripping members 114 and the heads 56 of the screws 54 once the decking planks 16 are secured to the joists 14, as described above.

Figure 8:
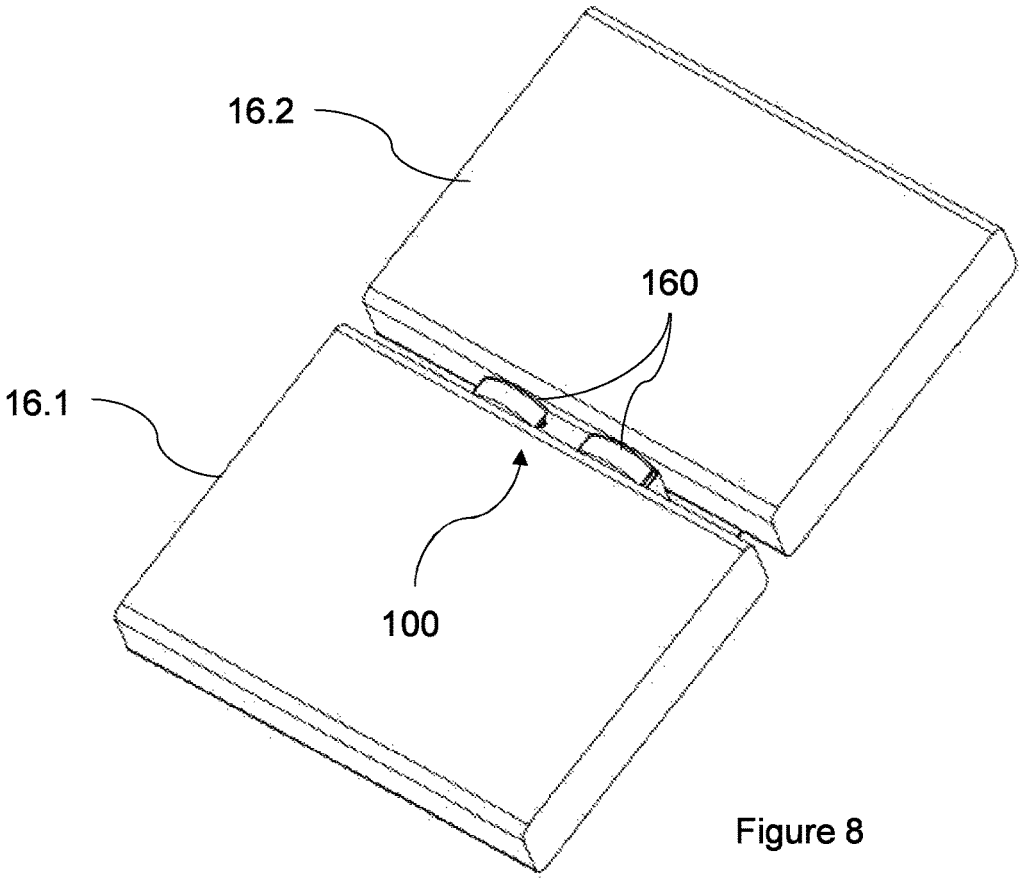
FIG. 8 shows the fastening assembly of FIG. 6, in use, with fastener covers in a closed condition.
Figure 9:
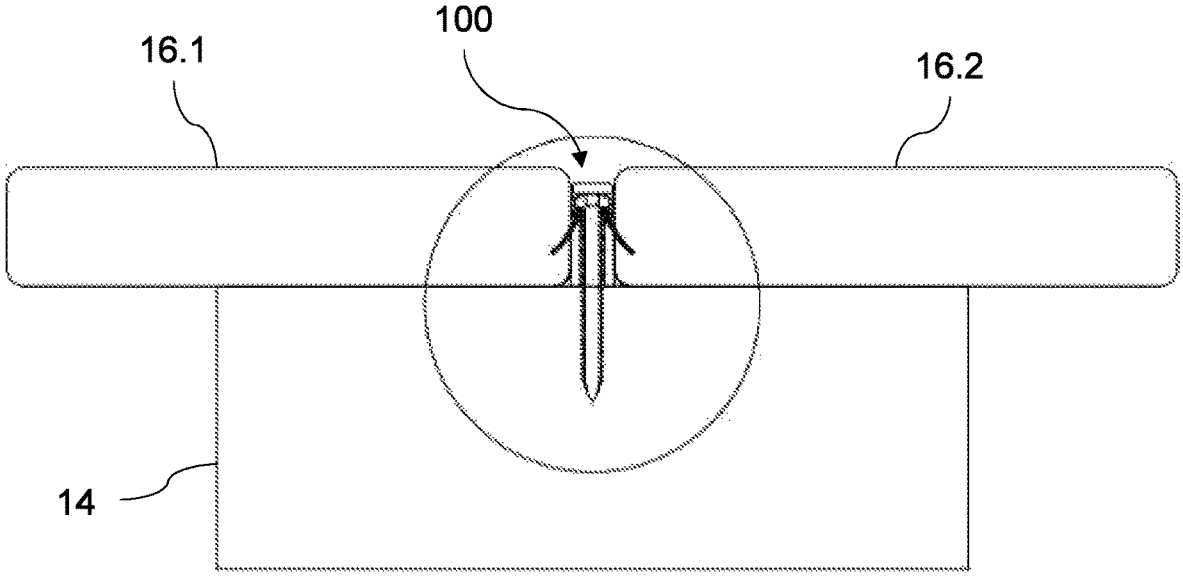
FIG. 9 shows a schematic, sectioned side view of the fastening assembly of FIG. 6, in use.
Figure 11C:
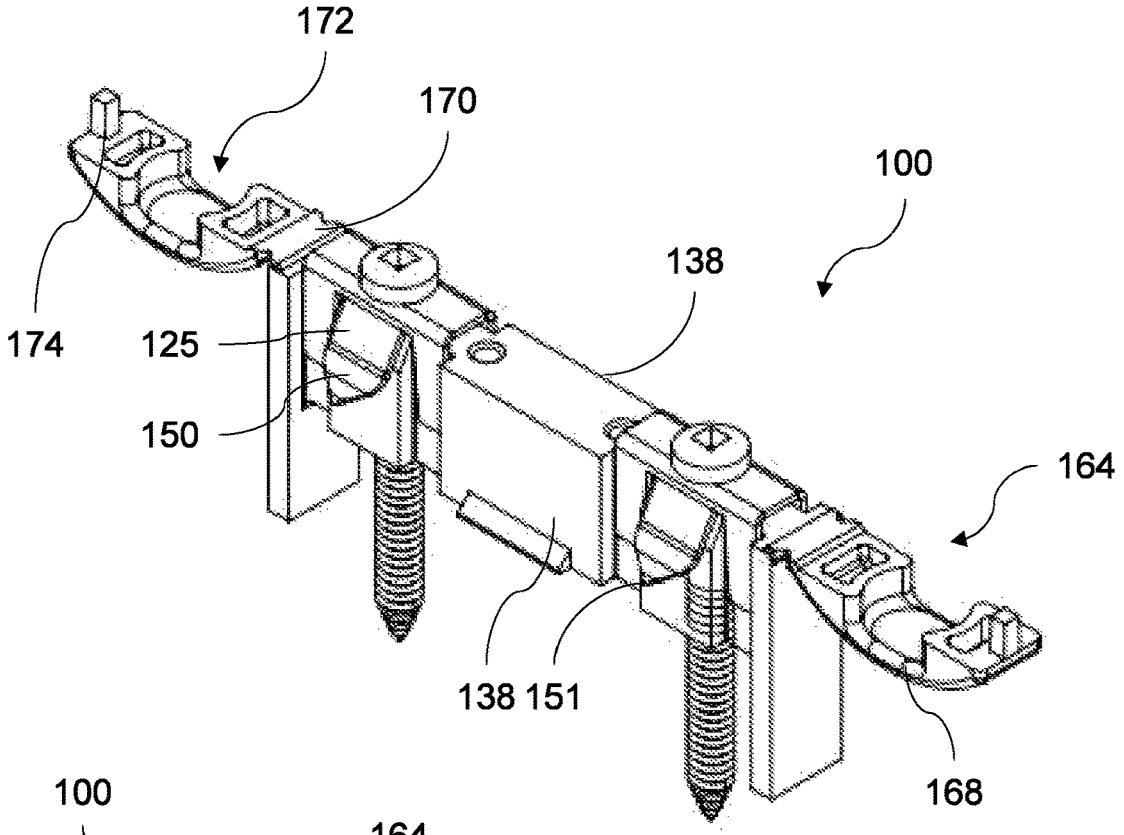
Figure 11D:
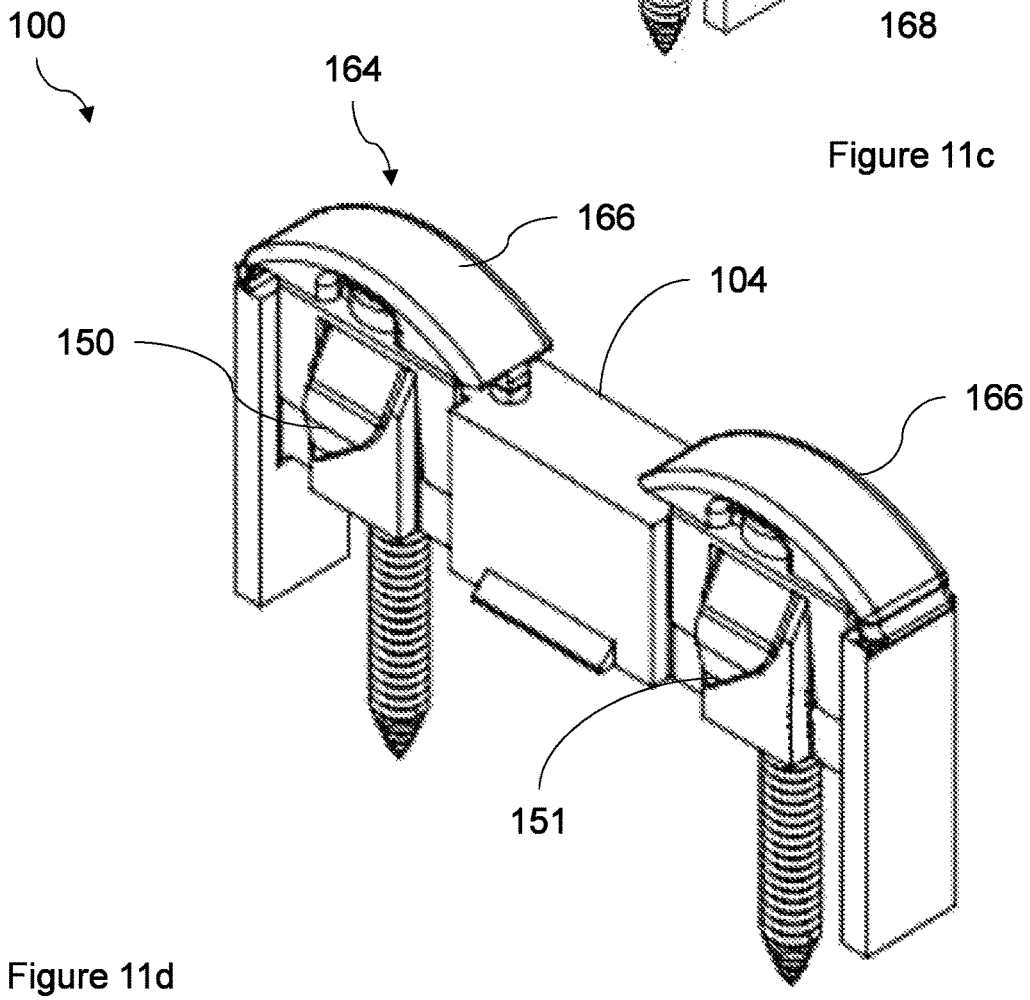

The cover mechanism 164 includes two covers 166, one for each of the two gripping members 114 and associated screws 54 of the fastening assembly 100. Each cover 166 includes a cover body 168 with a width that is substantially the same as the overall width of the body 126 of the spacer 104. This allows the cover body 168 to be received snugly between the planks 16. Each cover 166 includes a hinge 170 that pivotally connects an edge of the cover body 168 to one respective locator 130. The cover body 168 is dimensioned so that it can pivot between an inoperative position (FIGS. 6, 7, 11*c*), in which the heads 56 and gripping members 114 are uncovered to an operative position (FIGS. 8, 9, 11*d*), in which the heads 56 and gripping members 114 are covered by the cover bodies 168. The covers 166 are dimensioned so that, when the gripping members 114 are covered, the covers 166 are flush with, or below, the decking surface 62, to facilitate sanding, oiling, and other operations and activities carried out on the decking 12, without interference.

Each of the cover bodies 168 defines a recess 172 that is configured to accommodate the head 56 of the screw 54. A projection 174 extends from a free end of the cover body 168. The intermediate portion 132 defines two holes 176 that correspond with respective projections 174. The holes 176 and projections 174 are dimensioned so that the projections 174 are a friction fit in the respective holes 176 to secure the covers 166 in their operative positions, allowing the projections 174 to be released from the holes 176 so that the covers 166 can be manipulated into the inoperative positions.

Figure 13:
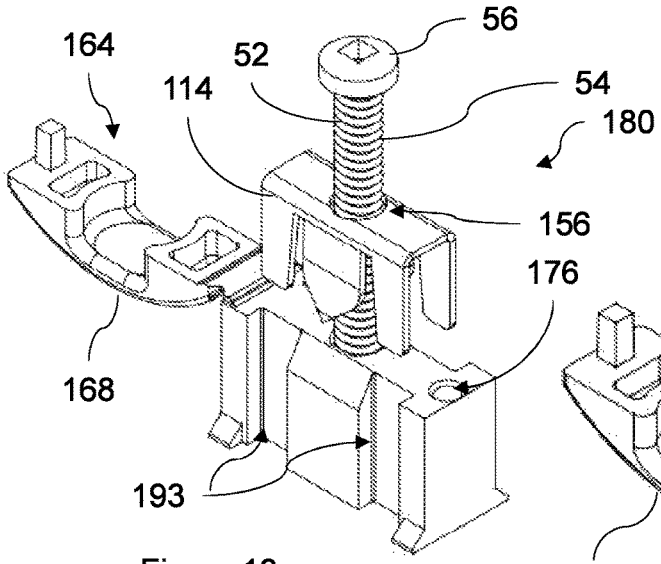
FIG. 13 shows an embodiment of a fastening assembly, in accordance with the invention, for decking, in a partially exploded condition.
Figure 14:
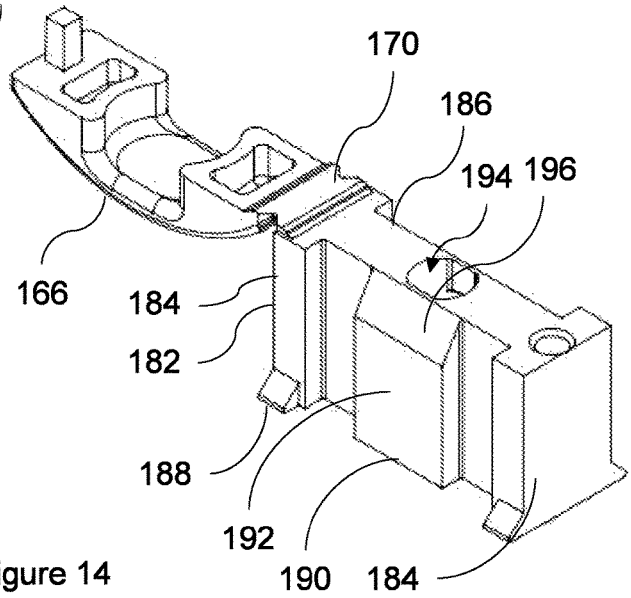
FIG. 14 shows a three-dimensional view of a spacer of the fastening assembly of FIG. 13.

In FIG. 13, reference numeral 180 generally indicates an embodiment of a fastening assembly, in accordance with the invention. With reference to the preceding drawings, like reference numerals refer to like parts, unless otherwise specified. The use of common reference numerals is for convenience only and is not intended to narrow the scope of the appended claims, or the above summary. Furthermore, the parts shown with reference to the fastening assembly 10 can be interchanged, where feasible, with parts shown with reference to the fastening assembly 180.

The fastening assembly 180 has one gripping member 114 and associated screw 54. The fastening assembly 180 is not intended to straddle or nest with the joist 14, as is the case with the assemblies 10, 100. Rather, the fastening assembly 180 is seated on the joist 14, in a desired location.

The fastening assembly 180 includes a spacer 182. The spacer 182 is generally rectangular. The spacer 182 includes two locating formations, or locators 184, and an intermediate portion 186 interposed between the locators 184. Two, opposed spacing formations extend from the locators 184 to provide an overall width of the spacer 182 to determine a desired spacing of the planks 16. The spacing formations are in the form of feet 188 that project from respective lower ends of the locators 184, to rest on the joist 14.

The intermediate portion 186 includes one spreader formation 190 that is centrally positioned between the locators 184. The spreader formation 190 is substantially the same as the spreader formation 144, with a raised face 192 and a sloped face 196 that extends downwardly and outwardly from an upper end of the intermediate portion 186. The faces 192, 196 are substantially the same as the faces 146, 148.

The locators 184 and the spreader formation 190 define two spaced slots 193 on each side of the intermediate portion 186. The legs 128 of the gripping member 114 can be received in respective slots 193. The spaced slots 193 serve the same function as the slots 142. The legs 128 of the gripping member 114 can be received in respective slots 193, with the raised and sloped faces 192, 196 interposed between respective two spaced slots 193.

A passage 194 extends from top to bottom through the intermediate portion 186, between the faces 192, 196 to be centrally located between the locators 184. Thus, as can be seen in FIG. 13, the shank 52 is received through the opening 156 and the passage 194 so that when the gripping member 114 is driven downwardly, as described above, the pointed ends 151 can dig into the sides 34.1, 34.2, as with the fastening assembly 100, to secure the fastening assembly 180 to the joist 14 and the planks 16.

The fastening assembly 180 includes the cover mechanism 164, with the cover 166 pivotally secured to one of the locators 184, and operable as described above.

The preceding description describes fastening assemblies with one or two gripping members. It is envisaged that fastening assemblies with three or more gripping members can be provided, depending on requirements of the application.

The spacers 18, 104, 182 described above can have overall dimensions of height, width, and length to suit a range of applications and differently dimensioned planks and joists.

The fastening assembly 10, 100, 180 provides a convenient and easy way to fasten conventional decking planks to joists, to form a deck, without the need for specialist skills or tools. The fact that the fastening assembly 10, 100, 180 can be used with a wide variety of conventional decking planks allows the supply of a single kit of parts that includes the spacers 18, 104, 182, the gripping members 28, 114, and the screws 54. It will be appreciated that the kit of parts need not be supplied with planks, allowing a consumer to source their own planks, which could be high-value planks that may have been recycled.

It will also be appreciated that the fastening assembly 10, 100, 180, facilitates the removal of decking from the joists 14 with a reduced risk of damage to the planks 16. In order to remove the planks 16, the covers 166 can be levered with a suitable tool to pivot into the inoperative position. The screws 54 can be unscrewed, and the gripping members 28, 114 prised off the spacers 18, 104, 182, out of engagement with the sides 34.1, 34.2, of the planks 16. The planks 16 can then be lifted from the joists 14 without the need to pry the planks 16 off the joists 14. Thus, the planks 16 can be recycled without openings or other damage, in close to their original condition before they were fastened to the joists 14.

The fastening assembly 100, 180 includes the covers 166 that can be used both to protect the gripping members 114 and screws 54 from corrosion and other damage arising from the ingress of water, and to enhance an appearance of the finished deck. This is apparent in FIG. 8, where the covers 166 provide a neat finish to the space between the planks 16.

In addition to its normal meaning, the word "plank" is to be understood to include panels, or similar articles, which could also be fastened to joists or beams with the fastening assembly 10, 100, 180, in the manner described herein.

Thus, the word "deck" or "decking" is to be regarded, in addition to its normal English meaning, as covering any structure that has planks, or plank-like elements or panels, fastened to a substructure, such as an array of joists, beams, or battens, or the like. This can be in the form of various structures, including low-level decks, balconies, boardwalks, and similar structures. It is not limited to a structure that is connected to a house or other building. It will also be readily appreciated that the fastening assembly 10, 100, 180 can be used to achieve any structural assembly in which planks, or plank-like elements or panels, are to be fastened consecutively to a substructure such as an array of joists, beams, battens, or the like. This could include vertical or horizontal structures such as vertical or horizontal screens, or other architectural structures. Thus, the fastening assembly 10, 100, 180 finds use for any application in which a consistent, evenly spaced layout of structural components on a substructure is desired. Furthermore, the assembly 10, 100, 180 is capable of achieving such a consistent, evenly spaced layout without the need to customise the planks or panels. It will therefore be appreciated that the spacer 18, 104, 182 can have a range of different overall dimensions to suit the application of the fastening assembly 10, 100, 180. For example, the spacer 18, 104, 182 can be supplied to suit joists or planks having a standard size, according to local building requirements.

The appended claims are to be considered as incorporated into the above description.

Throughout this specification, reference to any advantages, promises, objects or the like should not be regarded as cumulative, composite, and/or collective and should be regarded as preferable or desirable rather than stated as a warranty.

Throughout this specification, unless otherwise indicated, "comprise," "comprises," and "comprising," (and variants thereof) or related terms such as "includes" (and variants thereof)," are used inclusively rather than exclusively, so that a stated integer or group of integers may include one or more other non-stated integers or groups of integers.

When any number or range is described herein, unless clearly stated otherwise, that number or range is approximate. Recitation of ranges of values herein are intended to serve as a shorthand method of referring individually to each separate value falling within the range, unless otherwise indicated herein, and each separate value and each separate subrange defined by such separate values is incorporated into the specification as if it were individually recited herein.

Words indicating direction or orientation, such as "front", "rear", "back", etc, are used for convenience. The inventor(s) envisages that various embodiments can be used in a non-operative configuration, such as when presented for sale. Thus, such words are to be regarded as illustrative in nature, and not as restrictive.

The term "and/or", e.g., "A and/or B" shall be understood to mean either "A and B" or "A or B" and shall be taken to provide explicit support for both meanings or for either meaning.

Features which are described in the context of separate aspects and embodiments of the invention may be used together and/or be interchangeable. Similarly, features described in the context of a single embodiment may also be provided separately or in any suitable sub-combination.

It is to be understood that the terminology employed above is for the purpose of description and should not be regarded as limiting. The described embodiments are intended to be illustrative of the invention, without limiting the scope thereof. The invention is capable of being practised with various modifications and additions as will readily occur to those skilled in the art.

The invention claimed is:

1. A fastening assembly for decking having a plurality of joists with planks positioned on the joists, the fastening assembly comprising:

a spacer for positioning on a joist between adjacent planks, the spacer having a predetermined overall thickness so that the spacer serves to maintain a desired spacing between the planks, the spacer defining at least one passage that extends, top to bottom, through the spacer; and at least one gripping member, the gripping member including opposed arms and a web that interconnects the arms, with the spacer being receivable between the arms, wherein the web of the, or each, gripping member defines an opening, so that a shank of a fastener can be received through the web and the passage to engage the joist and drive the gripping member towards the joist so that the spacer is received between the arms, as the spacer is fastened to the joist, wherein the spacer includes end locating formations with a width corresponding to the predetermined thickness, and an intermediate portion interposed between the end locating formations, the intermediate portion being receivable between the arms of the, or each, gripping member, the intermediate portion defining at least one spreader formation that is receivable between the arms of the gripping member to drive the arms apart as the gripping member is driven downwardly so that free ends of the arms bear against respective adjacent sides of said adjacent planks to secure the planks to the spacer, and wherein the intermediate portion defines guide slots on respective sides of the, or each, spreader formation, the gripping member having opposed walls that depend from respective sides of the web, each wall having two slots to define the arm and two legs, with the arm interposed between the legs, the legs and the guide slots being configured so that the legs can slide into the guide slots as the gripping member is driven towards the joist.

2. The fastening assembly as claimed in claim 1, wherein the, or each, spreader formation has opposed sloped surfaces that extend downwardly and outwardly from an upper face of the spacer to facilitate driving the arms apart as the gripping member is driven downwardly.

3. The fastening assembly as claimed in claim 2, wherein each arm of the gripping member has a gripping portion that terminates the arm, the gripping portions extending outwardly to correspond with the sloped surfaces of the spreader formation.

4. The fastening assembly as claimed in claim 3, wherein each gripping portion defines a sharpened point that can be driven into the planks, as the gripping member is driven towards the joist.

5. The fastening assembly as claimed in claim 1, which includes two spreader formations, the intermediate portion defining a central portion interposed between end portions, each end portion being interposed between the central portion and one of the end locating formations, each end portion defining one of the spreader formations.

6. The fastening assembly as claimed in claim 5, wherein the central portion defines opposed faces, and each spreader formation defines opposed faces that terminate sloped surfaces, the faces of the central portion and spreader formations being aligned with each other and inwardly offset with respect to the width of the end locating formations to provide a gap between the faces of the central portion and spreader formations and the respective adjacent sides of the adjacent planks.

7. The fastening assembly as claimed in claim 6, wherein opposed spacing formations extend from respective faces of the central portion, outer edges of the spacing formations defining a width that corresponds with the width of the end locating formations to maintain the gap between the faces of the central portion and spreader formations and the respective adjacent sides of the adjacent planks.

8. The fastening assembly as claimed in claim 1, which includes the at least one gripping member and one corresponding spreader formation, the spreader formation being interposed between the end locating formations.

9. The fastening assembly as claimed in claim 1, which includes a cover body that is operatively engageable with the spacer to cover the, or each, gripping member to protect the gripping member.

10. The fastening assembly as claimed in claim 9, wherein the cover body is engageable with the spacer, the cover body being hinged to the spacer and pivotal between an operative position in which the cover body is located over the gripping member, and an inoperative position in which the cover body is positioned away from the gripping member to facilitate access to the gripping member.

11. The fastening assembly as claimed in claim 1, wherein the spacer is shaped to accommodate an upper side of the joist, to facilitate positioning of the spacer on the joist.

12. The fastening assembly as claimed in claim 1, wherein the spacer defines at least one recess on sides of the spacer, and accessible from an upper face of the spacer, each arm of the gripping member being slidably receivable, from the upper face towards a lower face of the spacer, in a respective one of the recesses, the recesses being shaped so that the arms are driven away from each other as the arms slide downwardly in the respective recesses.

13. The fastening assembly as claimed in claim 12, wherein at least a portion of a floor of each recess is ramped outwardly and downwardly to cause the arms to be driven away from each other as the gripping member is driven downwardly.

14. The fastening assembly as claimed in claim 1, wherein the free end of each arm defines an outwardly extending ridge for embedding in the planks when the arms are driven away from each other.

15. A decking assembly that comprises:

a series of spaced joists;

a series of decking planks positioned, side-by-side on the joists, transversely with respect to the joists; and a plurality of fastening assemblies interposed between the decking planks, each fastening assembly comprising:

a spacer for positioning on a joist between adjacent planks, the spacer having a predetermined overall thickness so that the spacer serves to maintain a desired spacing between the planks, the spacer defining at least one passage that extends, top to bottom, through the spacer; and at least one gripping member, the gripping member including opposed arms and a web that interconnects the arms, with the spacer being receivable between the arms, wherein the web of the, or each, gripping member defines an opening, so that a shank of a fastener can be received through the web and the passage to engage the joist and drive the gripping member towards the joist so that the spacer is received between the arms, as the spacer is fastened to the joist, wherein the spacer includes end locating formations with a width corresponding to the predetermined thickness, and an intermediate portion interposed between the end locating formations, the intermediate portion being receivable between the arms of the, or each, gripping member, the intermediate portion defining at least one spreader formation that is receivable between the arms of the gripping member to drive the arms apart as the gripping member is driven downwardly, and wherein the intermediate portion defines guide slots on respective sides of the, or each, spreader formation, the gripping member having opposed walls that depend from respective sides of the web, each wall having two slots to define the arm and two legs, with the arm interposed between the legs, the legs and the guide slots being configured so that the legs can slide into the guide slots as the gripping member is driven towards the joist.

16. A method of assembling decking having a plurality of joists with planks positioned on the joists, with a fastening assembly that comprises a spacer for positioning on a joist between adjacent planks, the spacer having a predetermined overall thickness so that the spacer serves to maintain a desired spacing between the planks, the spacer defining at least one passage that extends, top to bottom, through the spacer, and at least one gripping member, the gripping member including opposed arms and a web that interconnects the arms, with the spacer being receivable between the arms, wherein the web of the, or each, gripping member defines an opening, so that a shank of a fastener can be received through the web and the passage to engage the joist and drive the gripping member towards the joist so that the spacer is received between the arms, as the spacer is fastened to the joist, wherein the spacer includes end locating formations with a width corresponding to the predetermined thickness, and an intermediate portion interposed between the end locating formations, the intermediate portion being receivable between the arms of the, or each, gripping member, the intermediate portion defining at least one spreader formation that is receivable between the arms of the gripping member to drive the arms apart as the gripping member is driven downwardly, and wherein the intermediate portion defines guide slots on respective sides of the, or each, spreader formation, the gripping member having opposed walls that depend from respective sides of the web, each wall having two slots to define the arm and two legs, with the arm interposed between the legs, the legs and the guide slots being configured so that the legs can slide into the guide slots as the gripping member is driven towards the joist, the method comprising the steps of:

positioning at least two decking planks on a set of joists;

positioning the spacer between the planks to set a spacing between the decking planks; and driving the gripping member towards the joist so that the spacer is received between the arms and the arms are driven away from each other to bear against respective adjacent sides of said adjacent planks.

* * * * *